United States Patent [19]

Casbarian et al.

[11] Patent Number: 4,740,107

[45] Date of Patent: Apr. 26, 1988

[54] METHOD AND APPARATUS FOR PROTECTING A SHALLOW-WATER WELL

[75] Inventors: Aramis O. P. Casbarian, Metairie; Kenneth M. Dewalt, Covington, both of La.

[73] Assignee: Barnett & Casbarian, Inc., Metairie, La.

[21] Appl. No.: 83,935

[22] Filed: Aug. 5, 1987

Related U.S. Application Data

[63] Continuation of Ser. No. 936,285, Dec. 1, 1986.

[51] Int. Cl.[4] ..... E02D 31/10

[52] U.S. Cl. ..... 405/211; 175/5; 175/7; 166/367; 166/356; 405/195; 405/204; 405/227

[58] Field of Search ..... 405/230

[56] References Cited

U.S. PATENT DOCUMENTS

| | | | |
|---|---|---|---|
| 3,362,170 | 1/1968 | Manning | 405/208 |
| 3,389,562 | 6/1968 | Mott et al. | 405/227 X |
| 3,483,708 | 12/1969 | Marshall | 175/7 X |
| 3,508,409 | 4/1970 | Cargile | 175/5 X |
| 4,069,683 | 1/1978 | Janz | 405/228 X |
| 4,084,385 | 4/1978 | Boyadjieff | 405/228 |
| 4,109,476 | 8/1978 | Gracia | 405/169 |
| 4,110,993 | 9/1978 | Heerema | 405/228 |
| 4,228,857 | 10/1980 | Nobileau | 175/7 X |
| 4,269,542 | 5/1981 | Mueller | 405/196 |
| 4,391,332 | 7/1983 | Fayren | 166/350 |
| 4,401,398 | 8/1983 | Remson | 166/367 X |
| 4,422,805 | 12/1983 | Sweatman | 405/225 |
| 4,437,791 | 3/1984 | Reynolds | 405/195 |
| 4,558,973 | 12/1985 | Blandford | 405/216 |
| 4,592,422 | 6/1986 | Hipp | 166/96 |

FOREIGN PATENT DOCUMENTS

| | | | |
|---|---|---|---|
| 0019808 | 2/1985 | Japan | 405/228 |
| 0208513 | 10/1985 | Japan | 405/227 |
| 8401934 | 1/1986 | Netherlands | 405/227 |
| 1563107 | 3/1980 | United Kingdom | 405/227 |
| 2153886 | 8/1985 | United Kingdom | 405/227 |
| 0628232 | 10/1978 | U.S.S.R. | 405/227 |

*Primary Examiner*—Dennis L. Taylor

[57] ABSTRACT

A method and apparatus for protecting an isolated well conductor of a shallow-water well by installing a reinforcing frame against the well conductor near the water line and another frame on the ocean floor and then driving piles through aligned legs of the two frames and into the ocean floor, and subsequently operatively connecting the frames to the piles and the well conductor.

24 Claims, 3 Drawing Sheets

FIG. 4
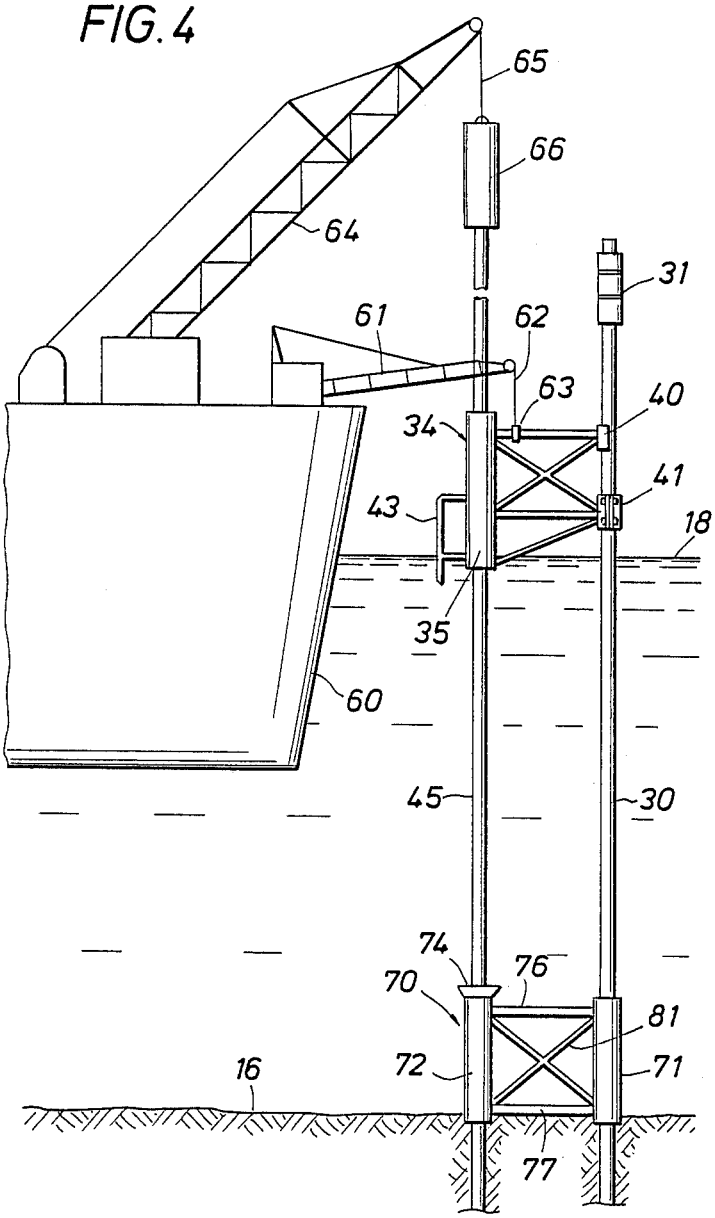
FIG. 6
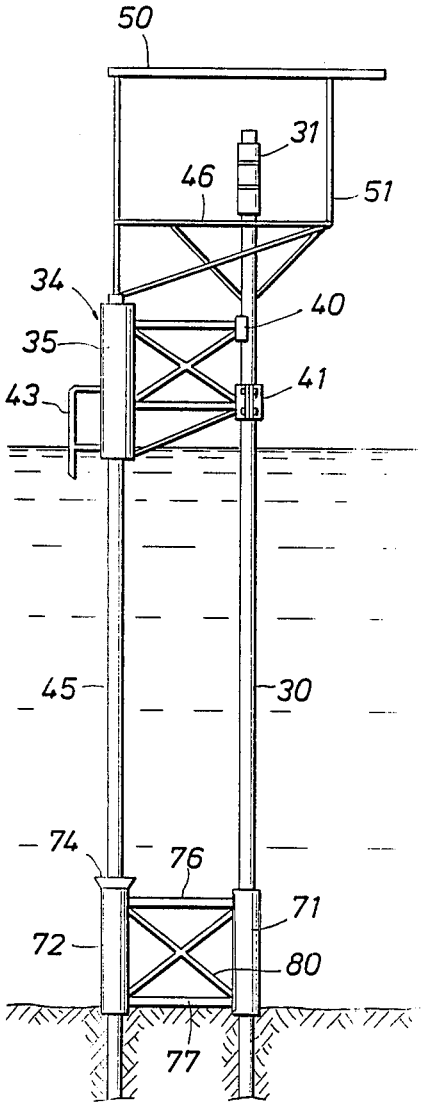
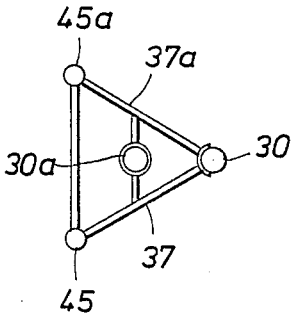
FIG. 9
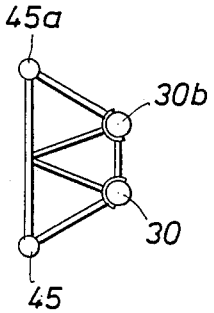
FIG. 10
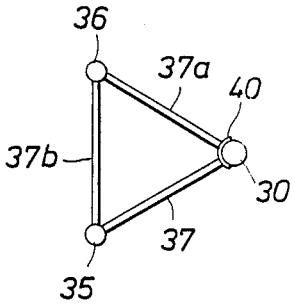
FIG. 5

METHOD AND APPARATUS FOR PROTECTING A SHALLOW-WATER WELL

This is a continuation of application Ser. No. 936,285, filed Dec. 1, 1986.

This invention relates to a method and apparatus for protecting the well conductor of a shallow water well which may be drilled from a jack-up rig in locations where only a few wells are to be drilled.

BACKGROUND OF THE INVENTION

From time to time, offshore structures in the form of large offshore platforms are erected on the ocean floor for the purpose of drilling a large number of wells into the ocean floor in order to develop oil or gas fields. In shallow water locations where small amounts of oil and gas have been found, the erection of a large platform could not be economically justified. Thus, at times, only a single well need be drilled down to the oil deposit. Alternatively, single wells are often drilled in extensions of known fields to develop small deposits. At other times, it is often desired to drill a single well and evaluate the field production for a year prior to going forward with further drilling of that area.

In shallow water of, say, 50 to 150 feet in depth, a single well would be drilled by driving a large diameter drive pipe or well conductor into the ocean floor. The well conductor, which may be 48 inches in diameter, forms the outer tubular member of a well installation. A well is drilled through the well conductor in a manner well known to the art and then is closed at the top by a well head assembly of the type used in producing a well. A single well of this type is normally protected by fabricating onshore a well protector jacket which is normally rectangular in cross-section and extends for a height equal to the distance between the ocean floor and the wellhead at the top of the well conductor. Such a jacket is transported by barge or otherwise to the offshore location where a derrick barge is employed to lift the jacket above the wellhead and slip it down over the wellhead and well conductor to the ocean floor. Piles are then driven down through the corner legs of the jacket to anchor it to the ocean floor.

SUMMARY OF THE INVENTION

The present invention is directed to apparatus for reinforcing shallow water wells and a method for installing the apparatus at an offshore location. The present apparatus includes simple structural components that require a minimum of labor offshore in connecting the apparatus to a well conductor. The apparatus is designed so that connections may be made readily above or below the water line to facilitate the assemblage of the apparatus.

It is an object of the present invention to provide apparatus to be connected to an unsupported well conductor to aid the conductor in resisting the forces of wind and waves to which it is subjected.

It is a primary object of the present invention to provide a method of drilling a shallow water offshore well and reinforcing the well structure from a work barge or other vessel having a crane and associated hoisting systems thereon. The method contemplates employing a jack-up drilling platform for driving a well conductor into the ocean floor and drilling the well through the conductor. Subsequent reinforcing of the well conductor with the apparatus of the present invention and driving piles through the reinforcing apparatus is carried out from a work barge or other vessel positioned near the well conductor. The jack-up platform is provided with a drilling rig or derrick which may be moveable laterally on its base platform or operating platform so that the derrick may be moved to an operative position which is outboard of the elevated operating platform. A jack-up platform having its derrick on a cantilevered section of the platform may be employed or, alternatively, a jack-up rig having a drilling slot in the platform extending inwardly from the outer edge thereof, may be used. Thus, in either case a jack-up platform may be employed which is of a design that provides for the derrick to be moved laterally to a selected position on the platform within a prescribed work area so that the center line of the derrick, and thus its hoist system, is positioned over open water to one side or outboard of the platform, or over the slot therein if one is present.

The jack-up drilling platform is located at a selected shallow water drilling location and its leg footings are set on the ocean floor while subsequently the operating deck is jacked up to the normal operating drilling position above the water surface and wave action. By use of the hoist system of the derrick, a large diameter well conductor, say, 48 inches in diameter, is lowered through the water below the derrick and set into the ocean floor. Generally, the well conductor is driven into the ocean floor by means of a pile driver to refusal, say, from 100 to 300 feet in the Gulf of Mexico. A well is drilled through the well conductor from the jack-up platform and the top of the well conductor is closed by means of a conventional wellhead located at, say, 50 feet or more above the mean water level.

In order to reinforce the finished well installation, a pair of relatively small reinforcing frames, which have been previously fabricated onshore, are transported by a work barge or other vessel to the well conductor where both frames are connected to the well conductor, one on the ocean floor and the other above the water surface. At least two corners of the reinforcing frames are provided with vertical pile guide sleeves of 10 feet or more in length through which piles may be driven into the ocean floor. Another corner of the reinforcing frames are provided with guide means in the form of a well conductor sleeve and/or connector means of a size to fit against and/or around the well conductor. The first or lower frame is lowered down the well conductor to the ocean floor, as by a lowering pipe or cable. With the second or upper reinforcing frame supported against the well conductor, as by means of a crane on the work barge, the hoist system of another crane on the work barge then picks up from 40 to 80 feet of pile and lowers it through vertically-aligned pile guide sleeves of the upper and lower frames and, by means of a pile driver connected to the upper end of the pile, drives it into the ocean floor. Additional lengths of pile are welded to the upper end of the driven pile in a manner well known to the art. The operation is repeated for the other piles. After the piles have been driven to the selected depths, they are connected to the reinforcing frames in any suitable manner. The frames are also connected to the well conductor either before or after the piles are driven.

By employing the method and apparatus of the present invention, well conductors of thinner walled pipe may be satisfactorily employed when reinforced in accordance with this invention. Additionally, single well conductors may be used in deeper waters with satisfactory results when protected in the present manner.

BRIEF DESCRIPTION OF THE DRAWING

These and other objects of the present invention will appear hereinafter from a consideration of the drawing and description.

FIG. 4 is a diagrammatic view of a work barge installing pile through reinforcing frames positioned against a well conductor;

FIG. 5 is a plan view of the frame of FIG. 4;

FIG. 6 is a partial side elevation view diagrammatically illustrating the final stage of the field installation of the reinforcing apparatus of the present invention which has been positioned and connected to the well conductor;

FIGS. 9 and 10 are plan views illustrating various arrangements of the reinforcing apparatus of the present invention when used on one or two wells.

DESCRIPTION OF A PREFERRED EMBODIMENT

Figure 1:
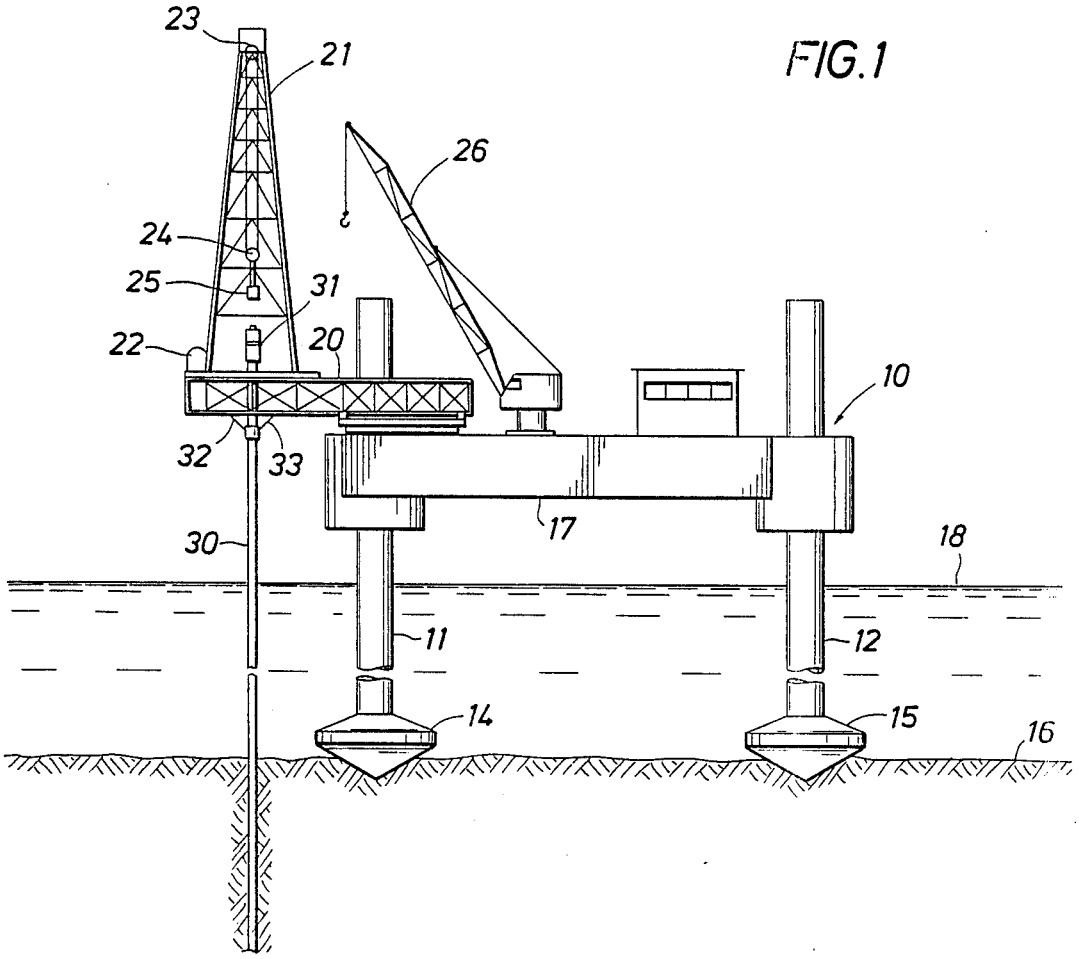
FIG. 1 is a side elevation view of a jack-up platform drilling a well in the ocean floor.

Referring to FIG. 1 of the drawing, an offshore jack-up platform or rig 10 is illustrated as being positioned at a drilling location offshore. Two of its three legs 11 and 12 are shown as having been jacked down so that the footings 14 and 15 at the lower end thereof rest on the ocean floor 16 with the operating platform 17 of the jack-up rig having been elevated above the ocean surface 18. In this case the jack-up rig 10 is provided with a cantilevered section of the operating deck 20 which extends outboard of the main deck section of operating platform 17. A drilling derrick 21 is mounted on the cantilevered section at operating deck 20. The derrick 21 is provided with a normal hoist system comprising a hoist 22, crown block 23, travelling block 24, and elevators 25 or other connection means for connecting and lowering pipe into a well. A crane 26 is shown as positioned on the deck of the platform to aid in carrying out operations.

Figure 2:
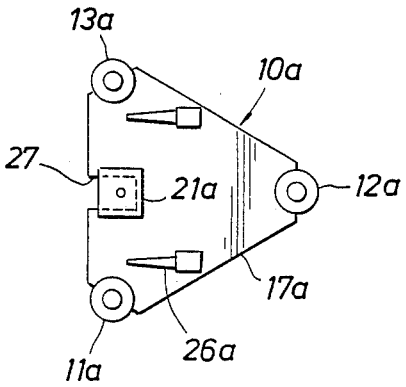
FIG. 2 is a plan view of another type of a jack-up platform having a slot in the operating platform.

In FIG. 2, another form of jack-up platform is shown as having legs 11A, 12A and 13A at the three corners of the triangular-shaped hull which may form the operating deck of the platform 10*a*. The operating deck 17*a* is shown as being provided with a slot 27 which extends inwardly from the outer edge of the deck or hull 17*a* a distance of, say, 35 or 40 feet. The width of the slot 27 is generally about 25 feet. The derrick 21*a* is shown as spanning the slot 27 and is moveable along the length and across the width of the slot as desired. Thus, with the platform located in its drilling position as shown in FIG. 1, the derrick can be moved laterally relative to the outer edge of the operating deck to any selected drilling location.

In FIG. 1 a well has been drilled through a well conductor 30 and is diagrammatically shown as being closed by a wellhead assembly 31. During drilling operations the well conductor may be supported in any suitable manner from the platform 20 as by means of cables 32 and 33. The platform of FIG. 2 may be provided with one or more cranes 26*a*.

Figure 3:
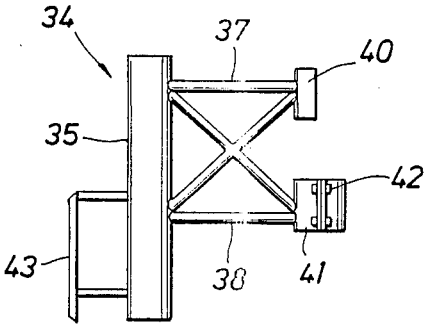
FIG. 3 is a side elevation view of one form of an upper reinforcing frame in accordance with the present invention.

One form of reinforcing frame or structure to be used above the water surface to reinforce an unsupported well conductor in shallow water may take the form of an upper or second pile guide template frame 34. The pile guide template frame 34 comprises at least two normally vertically-extending open-ended tubular pile guide sleeves or pile guides 35 and 36 (FIG. 8) of, say, an internal diameter of 40 inches so as to pass a 36-inch diameter pile therethrough. The frame 34 in FIG. 3 is shown as being provided with laterally-extending support members 37 and 38 which terminate in any suitable type of connector means 40 and 41 which are preferably configured on their inner surface to fit against or around a well conductor, as desired. The connector plate 40 is of the type that may be welded directly against the outside surface of the well conductor above the water line in order to support the pile guide frame 34 in place prior or subsequent to driving piles therethrough. The connector 41 shown at the end of the lower arm 38 is illustrated as being of the split collar type which would be connected to a well conductor by means of bolts 42. A split well conductor sleeve of similar construction could be used. In the event that boats are used to transfer personnel to a well installation to inspect it, the pile guide frame 34 is provided with a boat landing and bumper 43. The connectors 40 and 41 are positioned at a selected distance from each pile guide sleeve 35 and 36 (FIG. 11), which distance is determined by engineering considerations.

Figure 7:
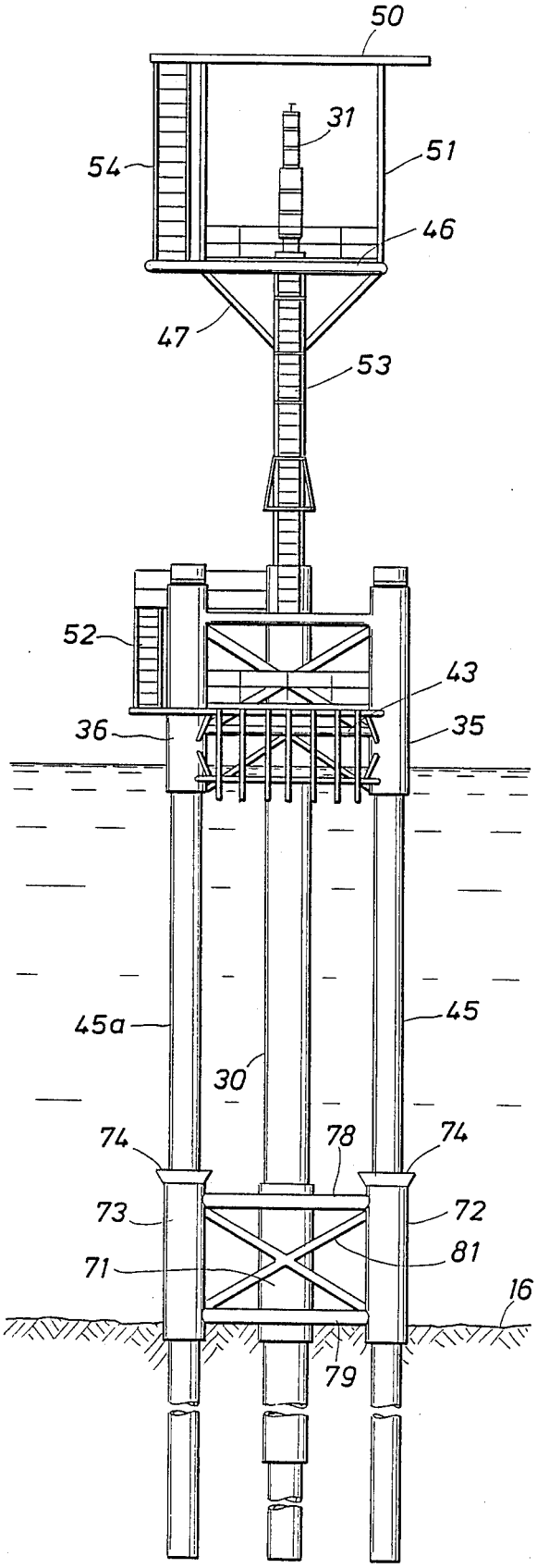
FIGS. 7 and 8 are side and front elevation views of a typical reinforced shallow water well.
Figure 8:
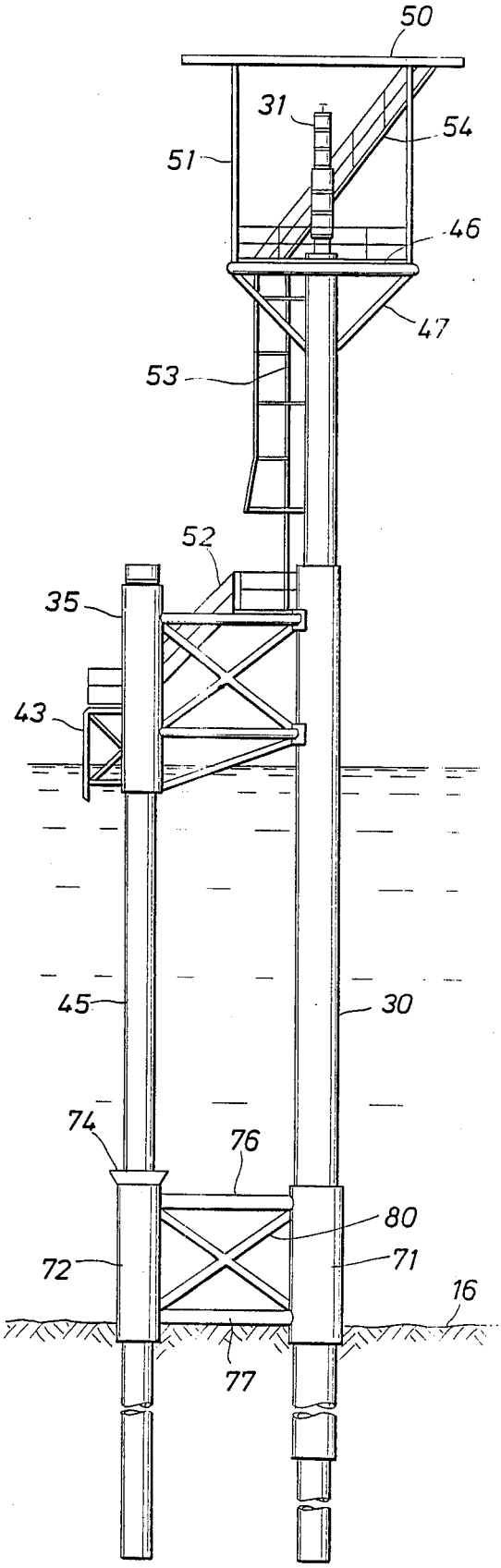

Another form of a reinforcing frame to be used on the ocean floor to reinforce an unsupported well conductor in shallow water and resist the forces at the ocean floor mud line, may take the form of a lower or first pile guide template frame 70, shown in FIG. 4. In plan view the frame 70 may be of any polygonal configuration, although a triangular or rectangular configuration is preferred. The lower template frame 70 (FIG. 4) comprises at least two normally vertically-extending open-ended tubular guide pile sleeves or pile guides 72 and 73 (FIG. 7) of preferably the same internal diameter of guide sleeves 35 and 36 of the upper frame 34 so that piles will fit within the upper and lower pile sleeves. To assemble the structure, it is necessary that the upper and lower frame sleeves be coaxially aligned. The lower frame 70 of FIGS. 7 and 8 is shown as being triangular in form as is the upper frame 34. Laterally-extending support or spacer members 76 and 77 and cross-bracing members 80 of a selected length connect the pile guide sleeve 72 to a well conductor sleeve 71 which loosely surrounds the well conductor 30 so that at least a 2-inch annular space is formed between the conductor 30 and the inner wall of the sleeve 71 into which grout may be pumped to connect the two together. Other laterally-extending support or spacer members 78 and 79 and cross-bracing members 81 of a selected length connect the pile sleeves 72 and 73 together in a spaced-apart manner that is equal to the spacing of the pile sleeves 35 and 36 of the upper frame 34. The tops of the pile sleeves 72 and 73 may be provided with bell-shaped or tapered openings 74 to facilitate the stabbing of pile into them.

In FIG. 4, the pile driving operation of the method of the present invention is illustrated as being carried out from a work barge 60, or any other suitable vessel equipped for pile driving which may float, or sit on the ocean floor. The barge 60 is provided with a crane 61 or other suitable equipment, having a hoist cable 62 and hook 63, for lowering the lower frame 70 to the ocean floor and for temporarily supporting the upper frame 34 above the water surface and against the well conductor 30 prior to affixing the connectors 40 and 41 to the well conductor 30 and/or driving pile 45 through guide sleeve 35. The work barge 60 is also provided with a hoisting crane 64 having a hoist cable 65 secured to the upper end of a suitable pile driver or hammer 66 which is adapted to engage or be operatively connected to a pile 45 to be driven.

As shown in FIG. 4, the work barge is anchored within working range of the unsupported well conductor 30. By use of a crane 64, the lower frame 70 has been picked up and lowered to the ocean floor. If the width of the wellhead 31 is no greater than the internal diameter of the well conductor sleeve 71, the sleeve 71 may be slipped over the wellhead 31 when the lower frame 70 is lowered to the ocean floor. Otherwise, the sleeve 71 could be of split construction like that of split coupling 41 of the upper frame 34. A split sleeve would be connected around the well conductor 31 before lowering the lower frame 70 to the ocean floor.

In FIG. 4 the pile guide template frame 34 of FIG. 3 has been transported in any suitable manner, as by barge 60, out to the unsupported well conductor 30 where it is picked up by any suitable hoist means 61 on the work barge 60 and positioned so that the connectors 40 and/or 41 (FIG. 3) are positioned against the well conductor 30 where they may be connected either before or after the pile driving operation. Preferably, the frame 34 is hung off the barge 60 at the desired level against the well conductor 30 with the boat landing 43 at water level.

With the pile guide frame 34 in place, and its pile guide sleeves 35 and 36 positioned in spaced-apart coaxial relationship with the pile guide sleeves 72 and 73 of the lower frame 70, the crane 64 is moved until its hoist cable 65 is positioned directly over one of the pile guide sleeves 35 or 36. Lengths of pile are then picked up one at a time and lowered down through the sleeve 35 and then down through sleeve 72 of the lower frame 70. Additional lengths of pile are welded to the upper end of the pile section being lowered in a manner well known to the art and the pile is driven into the ocean floor, as by means of a pile driver 66 in a manner well known to the art. The pile, when driven in place, is illustrated at 45 in FIG. 6. A follower pile may be used, if desired.

The crane 64 is then moved to a position over the other spaced-apart pile sleeve 36 (FIG. 7) and the operation of picking up piles, lowering them through the pile sleeve 36 of the upper frame 34 and pile sleeve 73 of the lower frame 70 and driving them into the ocean floor is repeated. Each of the piles 45 is fixedly secured to the surrounding pile sleeve in any manner well known to the art. For example, the top of each pile may be connected to its surrounding sleeve above the water by means of welding to spacers or shims. Additionally and/or alternatively, the annular space formed between each pile and its surrounding sleeves for both the upper and lower frames is filled with cement grout in a manner well known to the art.

Subsequently, an operating platform 46 may be mounted and affixed to the tops of the piles 45 and 45*a* and/or the upper end of the well conductor 30 below the wellhead assembly to allow personnel or maintenance men to inspect or maintain the well. If desired, a helicopter pad 50, as illustrated in FIG. 6, 7 and 8, may be mounted above the wellhead assembly 31 by means of a suitable support assembly or frame 51 which in turn is secured to the operating platform 46 and thence to the wellhead conductor 30. Suitable stairways or ladders 52, 53 and 54 can be provided so that personnel can move from the boat landing 43 or helicopter pad 50 to the operating platform 46.

In FIGS. 9 and 10 pile sleeve support frame configurations are shown which provide for two wells 30 and 30*a* in FIG. 9 with well 30A being separately supported to the support members 37 and 37*a* by additional cross bracing members. It is to be noted that well 30*a* falls within the periphery of the triangle formed between the piles 45 and 45*a* and the well 30. In FIG. 10, the wells 30 and 30*b* are on the periphery of the polygonal configuration of the reinforcing frame.

An alternative method of assembling the well conductor reinforcing equipment of the present invention is preferred in many shallow-water locations. In the alternative method, after the lower reinforcing frame 70 has been lowered to the ocean floor, at least one and preferably two piles 45 and 45*a* are installed in the pile guides 72 and 73, respectively, of the frame. The piles are then driven into the ocean floor a selected distance and then cut off at a selected height, say, 10 to 20 feet above the water surface. Subsequently, the upper reinforcing frame 34 is picked up by a hoist and moved into position and aligned so that the pile guides 35 and 36 may be lowered into concentric arrangement along the upper ends of the piles. The upper frame 34 may be temporarily connected to the piles, as by welding or clamping, until a permanent connection is made, as by welding or grouting. The deck and heliport structure may be fabricated on shore as a unit and moved to the well installation where it is landed on and secured to the tops of the piles and/or operatively connected to the well conductor.

We claim as our invention:

1. A method of drilling a shallow-water offshore well from a drilling barge and subsequently reinforcing on unsupported columnar well installation to resist the effect of wind and wave forces encountered by said well installation, said method comprising the steps of:

(a) installing a well conductor in an ocean floor at a shallow water location and anchoring it to the ocean floor, (b) drilling the well through said well conductor and closing the top of the well with a production wellhead, (c) providing a first pile guide template frame substantially polygonal in plan view comprising at least two spaced-apart vertical pile guides connected together by laterally-extending support members with additional laterally-extending support members arranged to extend between and be connected at one end to each of the pile guides and at the other end to a well conductor guide, with the pile guides being at a selected distance from the well conductor guide, (d) transporting the first pile guide template frame to the offshore unsupported well installation, (e) positioning said first pile guide template frame in vertical sliding arrangement on said well conductor below said production wellhead, (f) lowering said first pile guide template frame to the ocean floor, (g) providing a second pile guide template frame substantially polygonal in plan view comprising at least two spaced-apart vertical pile guides connected together by laterally-extending support members with additional laterally-extending support members arranged to extend between and be connected at one end to each of the pile guides and at the other end to the well conductor when positioned thereagainst, with the pile guides being at a selected distance from the well conductor, (h) transporting the second pile guide template frame to the offshore unsupported well installation, (i) positioning said second pile guide template frame in a manner such that the other ends of the additional laterally-extending support members are operatively positioned adjacent a wall of said well conductor, said position being such that at least said other ends of said support members at the top of the second pile guide template frame are above the surface of the water, (j) vertically aligning the pile guides of the second pile guide template frame over the pile guides of said first pile guide template frame on the ocean floor in spaced relationship therewith, (k) lowering a pile through each of said vertically-aligned pile guides of said first and second pile guide template frames and driving said pile into the ocean floor, (l) fixedly connecting each pile to its surrounding spaced-apart pile guides, and (m) operatively connecting at least said other ends of said laterally-extending support members at the top of the second pile guide template frame and said well conductor guide of said first pile guide template frame to the well conductor, whereby said spaced apart first and second pile guide template frames form interconnecting reinforcing structures between the piles and the well conductor to resist the effect of wind and wave forces encountered by said well conductor.

2. The method of claim 1 including the steps of providing a work platform at the base of said wellhead, and fixedly securing said work platform to at least said well conductor.

3. The method of claim 2 including the steps of providing a helicopter pad and a depending support frame, and fixedly securing said helicopter pad support frame to at least said work platform.

4. The method of claim 1 wherein the operation carried out in step (1) is accomplished by providing a sliding connection permitting limited movement between the well conductor and the second reinforcing template frame.

5. The method of claim 1 wherein step (i) the second pile guid template frame is positioned by hanging it from a crane of a work barge positioned nearby.

6. The method of claim 1 including the steps of:

providing a work barge having a pair of positionable hoisting cranes thereon, and positioning the work barge adjacent the well conductor and within the working area of the cranes.

7. The method of claim 6 wherein step (i) of claim 1 is carried out by temporarily connecting the second pile guide template frame to a hook of the first crane of the pair of cranes and moving the first crane to suspend the second pile guide template frame against the well conductor during the pile driving operation of step (j).

8. The method of claim 6 including the step of utilizing the second crane of the pair of cranes on the work barge to suspend a length of the pile and a pile driver operatively connected thereto above a set of vertically-aligned spaced-apart pile guides of the first and second pile guide template frames prior to driving the pile through the pile guides.

9. The method of claim 1 wherein the step of connecting the first and second pile guide template. frames to the well conductor is carried out after the pile driving operation.

10. The method of claim 9 wherein the step of connecting the second pile guide template frame to the well conductor is carried out by welding.

11. The method of claim 1 wherein the step of connecting the second pile guide template frame to the well conductor is carried out before the pile driving operation of step (j) of claim 1.

12. The method of claim 1 wherein connecting piles to their surrounding pile guides comprises grouting the piles within their pile guides.

13. The method of claim 12 wherein connecting the well conductor to its surrounding well conductor guide comprises grouting the well conductor within the well conductor guide.

14. A well installation into an ocean floor for isolated use offshore, said well installation comprising:

(a) an unsupported well conductor installed in the ocean floor and having a well drilled therethrough and closed at the upper end above the wave height by a production wellhead assembly, (b) a first pile guide template frame positioned on the ocean floor and comprising a guide sleeve surrounding said well conductor and laterally-extending support members fixedly secured to said guide sleeve and extending outwardly to at least one side of said well conductor, (c) said first pile guide template frame having at a selected distance from the well conductor at least two spaced-apart open-ended and vertically-positioned tubular rigid pile sleeves at least 10 feet in height and extending at least 10 feet upwardly from the ocean floor, (d) a second pile guide template frame positioned on the outside of said well conductor adjacent the surface of the water and comprising laterally-extending support members fixedly secured at least above the water line to the outer surface of the well conductor below the wellhead assembly and extending outwardly to at least one side of said well conductor, (e) said second pile guide template frame having, at a selected distance from the well conductor, at least two spaced-apart open-ended and vertically-positioned tubular rigid pile sleeves at least 10 feet in height and extending at least 10 feet upwardly from the water surface, said pile sleeves being in vertical alignment with the pile sleeves of said first frame, (f) a large-diameter pile extending through each of at least two of the spaced-apart pile sleeves of said spaced apart first and second guide frames with the lower end of each pile being anchored in the ocean floor, and (g) means for fixedly securing each pile within its surrounding sleeve.

15. The apparatus of claim 14 wherein the means (g) comprises cement grout filling the annular spaces formed between each pile and the surrounding pile sleeves.

16. The apparatus of claim 14 wherein the pile sleeves of said first pile guide template frame extend upwardly from the ocean floor from 5 to 40 feet.

17. The apparatus of claim 14 including a work platform position adjacent said wellhead assembly and support means for fixedly securing said work platform to at least the well conductor.

18. The apparatus of claim 14 including a helicopter pad positioned over said wellhead assembly, and support means for fixedly securing said helicopter pad to at least the well conductor.

19. The apparatus of claim 14 wherein the laterally-extending support members of said first and second pile guide template frames together with said pile sleeves and well conductor, when taken in plan view, are arranged in a polygonal configuration with the pile sleeves and the well conductor positioned on the periphery thereof.

20. The apparatus of claim 17 further including a second well conductor connected to the first and second pile guide template frames and anchored in the ocean floor.

21. The apparatus of claim 20 wherein said second well conductor is positioned on the periphery of the polygonal configured first and second pile guide template frames.

22. The apparatus of claim 20 wherein said second well conductor is positioned within the periphery of said polygonal configured first and second pile guide template frames and including additional lateral support members connecting the second well conductor to the first and second pile guide template frames.

23. The apparatus of claim 20 wherein said second well conductor is positioned outside the periphery of said polygonal configured frame and including additional lateral support members connecting the second well conductor to the frame.

24. A method of drilling a shallow-water offshore well from a drilling barge and subsequently reinforcing an unsupported columnar well installation to resist the effect of wind and wave forces encountered by said well installation, said method comprising the steps of:

(a) installing a well conductor in the ocean floor at a shallow water location and anchoring it to the ocean floor, (b) drilling a well through said well conductor and closing the top of the well with a production wellhead, (c) providing a first pile guide template frame substantially polygonal in plan view comprising at least two spaced-apart vertical pile guides connected together by laterally-extending support members with additional laterally-extending support members arranged to extend between and be connected at one end to each of the pile guides and at the other end to a well conductor guide, with the pile guides being at a selected distance from the well conductor guide, (d) transporting the first pile guide template frame to the offshore unsupported well installation, (e) positioning said first pile guide template frame in vertical sliding arrangement on said well conductor below said wellhead, (f) lowering said first pile guide template frame to the ocean floor, (g) lowering a pile through each of at least two of said vertical pile guides of said first pile guide template frame and driving said pile into the ocean floor with the upper end of the pile extending above the water surface, (h) providing a second pile guide template frame substantially polygonal in plan view comprising at least two spaced-apart vertical pile guides connected together by laterally-extending support members with additional laterally-extending support members arranged to extend between and be connected at one end to each of the pile guides and at the other end to the well conductor when positioned thereagainst, with the pile guides being at a selected distance from the well conductor, (i) transporting the second pile guide template frame to the offshore unsupported well conductor, (j) positioning said second pile guide template frame in a manner and direction such that the other ends of the additional laterally-extending support members are operatively positioned adjacent the wall of said well conductor when the second pile guide template frame is in its final operative position, said position being such that at least said other ends of said support members at the top of the second pile guide template frame are above the surface of the water, (k) raising the second pile guide template frame to position where at least two of its vertical pile guides are aligned above the upper ends of piles extending above the water surface, and lowering the second pile guide template frame and its pile guides down over the tops of the piles so that they are positioned therein, (l) fixedly connecting each pile to its surrounding spaced-apart pile guides, and (m) operatively connecting at least said other ends of said laterally-extending support members at the top of the second pile guide template frame and said well conductor guide of said first pile guide template frame to the well conductor, whereby said spaced-apart first and second pile guide template frames form interconnecting reinforcing structures between the piles and the well conductor to resist the effect of wind and wave forces encountered by said well conductor.

* * * * *